US012751529B2

(12) United States Patent
Felgar et al.

(10) Patent No.: US 12,751,529 B2
(45) Date of Patent: Oct. 6, 2026

(54) BUTTON-BLOCKING PROTECTIVE CASE FOR MOBILE DEVICES

(71) Applicant: RAZ Mobility, LLC, Cabin John, MD (US)

(72) Inventors: Robert Felgar, Cabin John, MD (US); Nermin Selimic, Cabin John, MD (US)

(73) Assignee: RAZ Mobility, LLC, Cabin John, MD (US)

( * ) Notice: Subject to any disclaimer, the term of this patent is extended or adjusted under 35 U.S.C. 154(b) by 200 days.

(21) Appl. No.: 18/828,460

(22) Filed: Sep. 9, 2024

(65) Prior Publication Data

US 2026/0069010 A1 Mar. 12, 2026

(51) Int. Cl.
*A45C 11/00* (2006.01)

(52) U.S. Cl.
CPC ..... *A45C 11/00* (2013.01); *A45C 11/002* (2025.01)

(58) Field of Classification Search
CPC ..... A45C 11/00; A45C 11/002
See application file for complete search history.

(56) References Cited

U.S. PATENT DOCUMENTS

| | | | | |
|---|---|---|---|---|
| 9,314,078 | B1 | 4/2016 | Haymond et al. | |
| 9,741,188 | B2 | 8/2017 | Seagraves et al. | |
| 2011/0233078 | A1* | 9/2011 | Monaco | H04R 1/02 206/223 |
| 2011/0309728 | A1 | 12/2011 | Diebel | |
| 2012/0262618 | A1 | 10/2012 | Weakly | |
| 2015/0194994 | A1 | 7/2015 | Soriano et al. | |
| 2015/0270734 | A1 | 9/2015 | Davison et al. | |
| 2015/0280769 | A1 | 10/2015 | Thomson | |
| 2015/0374087 | A1 | 12/2015 | Lim et al. | |
| 2015/0381226 | A1* | 12/2015 | Mogol | H04B 1/3888 455/575.1 |
| 2020/0304620 | A1 | 9/2020 | Wang | |
| 2021/0126666 | A1 | 4/2021 | Ng et al. | |
| 2022/0158681 | A1* | 5/2022 | Fathollahi | H04B 1/3888 455/575.8 |

FOREIGN PATENT DOCUMENTS

| | | | | |
|---|---|---|---|---|
| CN | 107205533 B | * | 10/2019 | A45C 11/00 |

OTHER PUBLICATIONS

CN107205533B with English translation (Year: 2019).*

* cited by examiner

*Primary Examiner* — Alison Slater
(74) *Attorney, Agent, or Firm* — Scale LLP

(57) ABSTRACT

A mobile device system includes a mobile device having a housing and one or more buttons disposed on the housing, and a case configured to receive the mobile device. The protective case comprises an outer surface and an inner surface having indentations corresponding to the one or more buttons of the mobile device. The indentations are configured to prevent a user from pressing the one or more buttons when the mobile device is inserted into the protective case. The protective case allows access to ports of the mobile device while preventing access to the buttons, providing protection against both intentional and accidental button presses for users with cognitive decline.

20 Claims, 14 Drawing Sheets

BUTTON-BLOCKING PROTECTIVE CASE FOR MOBILE DEVICES

FIELD OF THE DISCLOSURE

The present disclosure relates to protective cases for mobile devices, and more particularly to cases that may prevent both intentional and accidental activation of device buttons while allowing access to other device features.

BACKGROUND

Mobile devices, such as smartphones and tablets, have become an integral part of modern life. These devices often include various buttons and controls for adjusting settings, powering the device on and off, and controlling volume. While these buttons provide important functionality, they can sometimes pose challenges for certain users, particularly those with cognitive impairments, such as dementia, or limited dexterity.

Protective cases for mobile devices are widely used to shield the devices from physical damage due to drops, impacts, or scratches. Traditional cases typically provide openings or raised buttons that allow users to access and operate the device's physical controls. However, this design can sometimes lead to unintended button presses, potentially causing frustration or confusion for users who may accidentally turn off their device or change important settings.

For individuals with cognitive decline, such as seniors experiencing dementia or other memory loss or cognitive impairments, accidental button presses can be particularly problematic. These users may have difficulty remembering how to power on a device that has been accidentally turned off or may become confused by unexpected changes in volume or other settings. This can lead to reduced independence and increased reliance on caregivers for assistance with basic device operations.

Additionally, many existing protective cases focus primarily on physical protection without considering the specific needs of users with cognitive or physical limitations. There is a growing need for assistive technologies that can help these individuals maintain their independence and continue using mobile devices effectively.

Improvements in case design that address these challenges while still providing robust physical protection could greatly benefit users with special needs, as well as their caregivers and family members. Such advancements could potentially increase the accessibility of mobile devices for a wider range of users and promote greater independence in daily technology use.

SUMMARY

The following description presents a simplified summary in order to provide a basic understanding of some aspects described herein. This summary is not an extensive overview of the claimed subject matter. It is intended to neither identify key or critical elements of the claimed subject matter nor delineate the scope thereof.

According to aspects of the present disclosure, a mobile device system is provided. The mobile device system includes a mobile device having a housing and one or more buttons disposed on the housing. The system also includes a case configured to receive the mobile device. The case comprises an outer surface and an inner surface having one or more indentations corresponding to the one or more buttons of the mobile device. The one or more indentations are configured to prevent a user from pressing the one or more buttons when the mobile device is inserted into the case.

According to aspects of the present disclosure, the mobile device system may include one or more of the following features. A portion of the outer surface that aligns with the one or more buttons when the mobile device is inserted into the case may be flat and lack protrusions. The one or more indentations may comprise a first indentation and a second indentation, and the first indentation and the second indentation may have different shapes or dimensions. The one or more indentations may be integrally formed with the inner surface of the case. The case may comprise a shock-absorbing material. The shock-absorbing material may be selected from the group consisting of silicone, rubber, and thermoplastic polyurethane (TPU). The one or more indentations may comprise at least a first indentation, a second indentation, and a third indentation. The first indentation and the second indentation may be spaced by a first distance. The second indentation may be located between the first indentation and the third indentation. The second indentation and the third indentation may be spaced by a second distance. The second distance may be greater than the first distance. The one or more buttons may include power and volume buttons. The case may be configured to allow access to one or more ports of the mobile device while preventing access to the one or more buttons.

According to aspects of the present disclosure, a case for a mobile device is provided. The case includes an outer surface and an inner surface configured to receive the mobile device. The inner surface has one or more indentations corresponding to one or more buttons of the mobile device. The one or more indentations are configured to prevent a user from pressing the one or more buttons when the mobile device is inserted into the case.

According to aspects of the present disclosure, the case may include one or more of the following features. A portion of the outer surface that aligns with the one or more buttons when the mobile device is inserted into the case may be flat and lack protrusions. The one or more indentations may comprise a first indentation and a second indentation, and the first indentation and the second indentation may have different shapes or dimensions. The one or more indentations may be integrally formed with the inner surface of the case. The case may comprise a shock-absorbing material. The shock-absorbing material may be selected from the group consisting of silicone, rubber, and thermoplastic polyurethane. The one or more indentations may comprise at least a first indentation, a second indentation, and a third indentation. The first indentation and the second indentation may be spaced by a first distance. The second indentation may be located between the first indentation and the third indentation. The second indentation and the third indentation may be spaced by a second distance. The second distance may be greater than the first distance. The outer surface may be a first outer surface, and the case may further include a second outer surface, a third outer surface, and a fourth outer surface. The first outer surface may be located opposite the third outer surface, the second outer surface may be located opposite the fourth outer surface, the first outer surface and the third outer surface may have a greater length than the second outer surface and the fourth outer surface, and the first outer surface and the third outer surface may be flat and not contain any protrusions or openings. At least one of the second outer surface or the fourth outer surface may include one or more openings configured to provide access to one or more ports of the mobile device.

The inner surface having the one or more indentations may be a first inner surface, and the case may further include a second inner surface, a third inner surface, and a fourth inner surface. The first inner surface may be located opposite the third inner surface, the second inner surface may be located opposite the fourth inner surface, and the first inner surface and the third inner surface may have a greater length than the second inner surface and the fourth inner surface. At least one of the second inner surface or the fourth inner surface may include one or more openings configured to provide access to one or more ports of the mobile device.

Further variations encompassed within the systems and methods are described in the detailed description of the invention below.

BRIEF DESCRIPTION OF THE DRAWINGS

The accompanying drawings, which are incorporated in and constitute a part of this specification, show certain aspects of the subject matter disclosed herein and, together with the descriptions, help explain some of the principles associated with the disclosed implementations.

DETAILED DESCRIPTION

While aspects of the subject matter of the present disclosure may be embodied in a variety of forms, the following description and accompanying drawings are merely intended to disclose some of these forms as specific examples of the subject matter. Accordingly, the subject matter of this disclosure is not intended to be limited to the forms or embodiments so described and illustrated.

Figure 1:
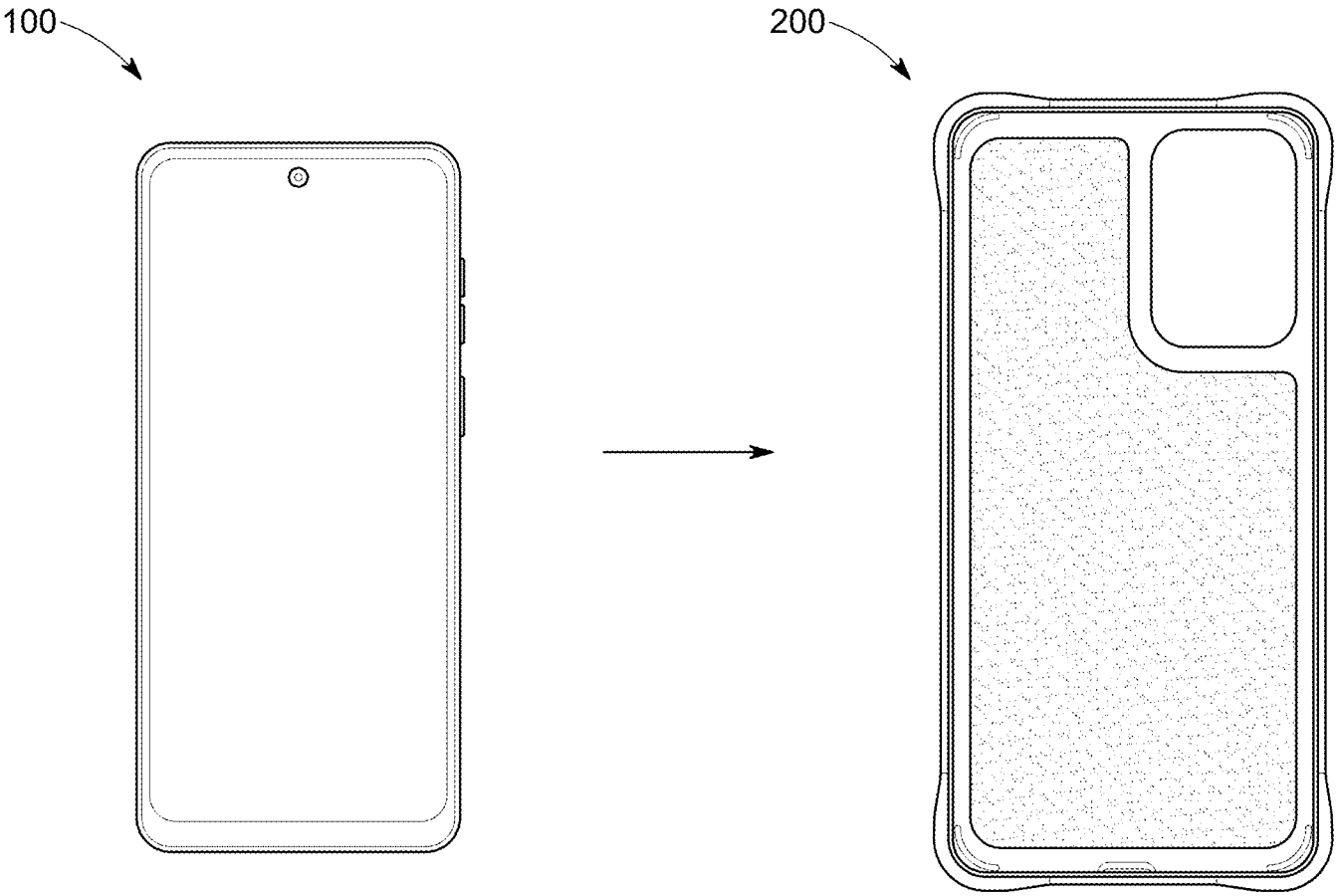
FIG. 1 depicts a mobile device and case according to aspects of the present disclosure.

FIG. 1 depicts a mobile device system comprising a mobile device 100 and a case 200 according to aspects of the present disclosure. The mobile device 100 may be, for example, a smartphone, tablet, or other portable electronic device. The case 200 may be configured to removably receive and protect the mobile device 100. In some aspects, the case 200 may be made of a shock-absorbing material to provide protection against drops and impacts.

Figure 2:
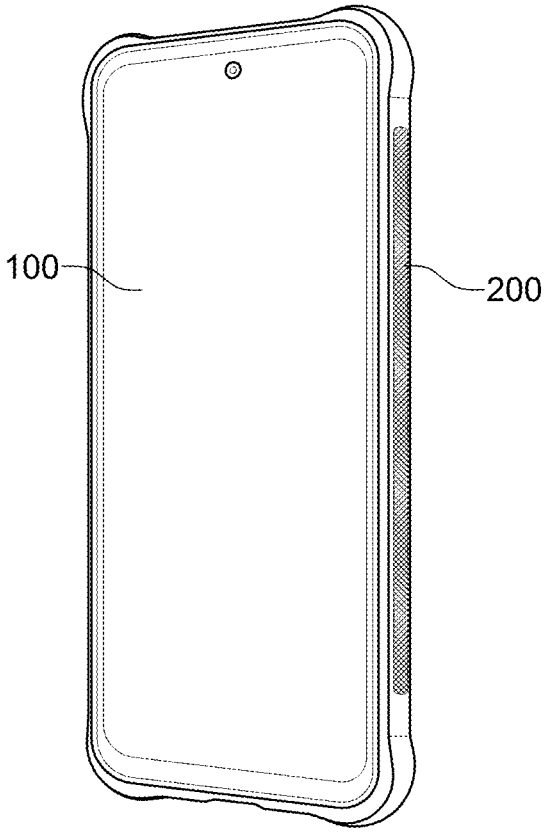
FIG. 2 depicts a front view of the mobile device inserted into the case according to aspects of the present disclosure.

FIG. 2 depicts a front view of the mobile device 100 inserted into the case 200. The case 200 may have an outer surface that surrounds and protects the edges and back of the mobile device 100 while leaving the front display area of the mobile device 100 exposed for viewing and interaction.

In some aspects, the mobile device 100 may be insertable into the case 200 using a snap-on design that allows for easy installation. The case 200 may include flexible edges or corners that can temporarily deform to accommodate the insertion of the mobile device 100 and then return to their original shape, securely gripping the device. This design may provide a snug fit while still allowing for easy removal when desired.

In some aspects, the case 200 may utilize a slide-in design, where the mobile device 100 can be inserted from one end of the case and slid into place. This method may provide a smooth installation process while ensuring a secure fit once the device is fully inserted. The case 200 may also incorporate a combination of these methods or other designs that facilitate easy and removable installation.

Regardless of the specific installation method, the case 200 may be designed to securely fix to the mobile device 100 once installed. This secure attachment may be achieved through a combination of factors, such as the precise dimensioning of the case to match the mobile device, the use of friction-enhancing materials on the inner surface of the case, or the incorporation of subtle ridges or protrusions that engage with corresponding features on the mobile device.

In some aspects, the case 200 may include reinforced corners or edges that provide additional grip on the mobile device 100, enhancing the security of the attachment while still allowing for easy removal when desired. These features may work in conjunction with the overall design of the case to provide a balance between ease of installation and removal, and secure attachment during use.

Figure 3:
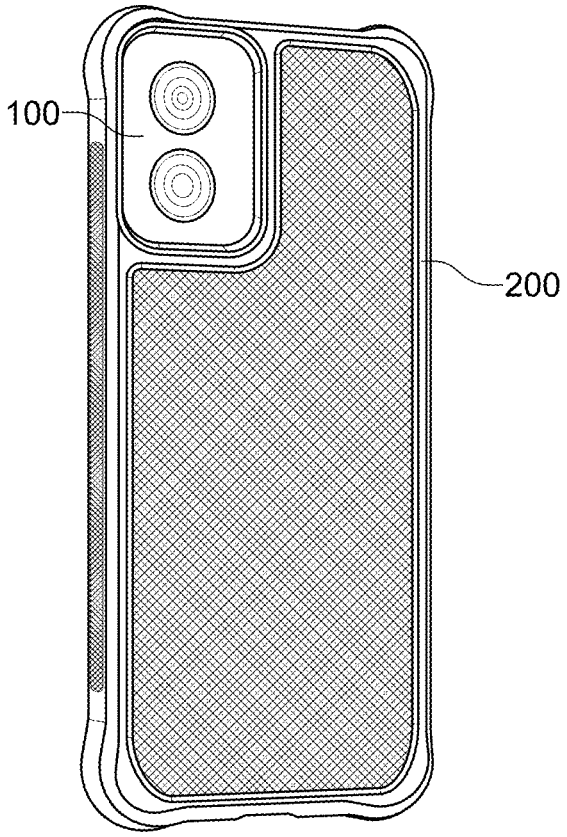
FIG. 3 depicts a rear view of the mobile device inserted into the case according to aspects of the present disclosure.

FIG. 3 depicts a rear view of the mobile device 100 inserted into the case 200. The case 200 may cover and protect the back of the mobile device 100. In some aspects, the case 200 may include one or more cutouts or openings to allow access to features on the back of the mobile device 100, such as a camera lens. One or more outer portions of the case 200 may be made of a rigid material to provide protection, while one or more inner portions in contact with the mobile device 100 may comprise a softer material.

In some aspects, the rigid material of the outer portions of the case 200 may comprise TPU material. TPU may provide a balance of durability and flexibility, offering protection against impacts while allowing for ease of installation and removal of the mobile device. In some aspects, the rigid material of the outer surface of the case 200 may comprise materials other than TPU. For example, the rigid material may include rubber, silicone, or other polymeric materials that provide durability and impact resistance. These materials may be selected based on their ability to offer protection against drops and impacts while maintaining a desired level of flexibility. In some cases, the case 200 may incorporate a combination of materials, such as a rubber or silicone outer layer with a harder inner shell, to provide enhanced protection and grip. The specific material or combination of materials used for the rigid outer surface may be chosen to optimize the balance between protection, flexibility, and ease of use for different mobile device models or user preferences.

The softer material of the inner portion may comprise microfiber lining. A softer material such as a microfiber lining may provide a gentle, scratch-resistant surface that contacts the mobile device, helping to prevent damage to the device's finish while also offering some cushioning properties.

Figure 4:
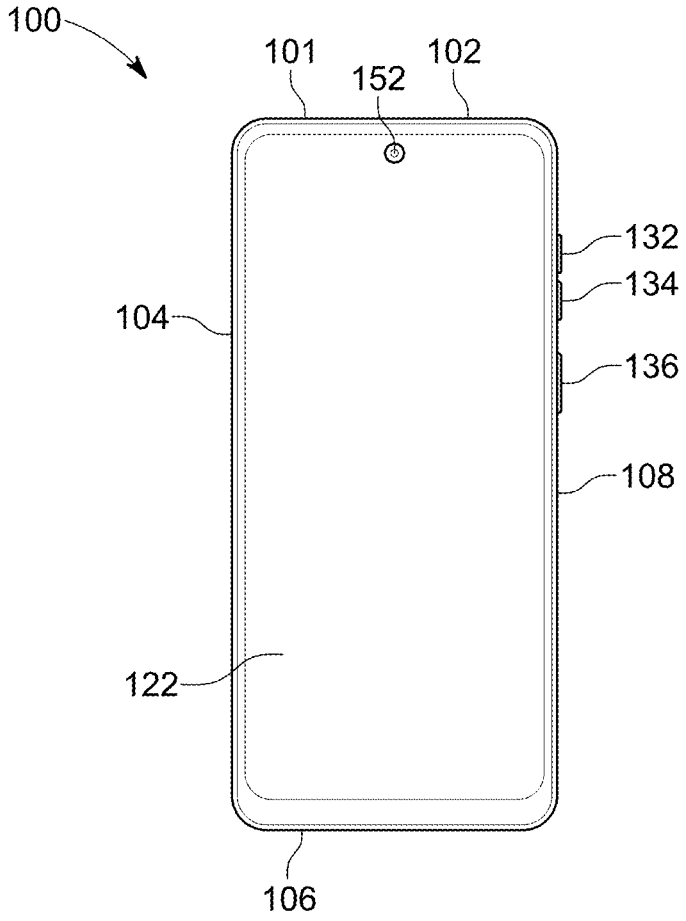
FIG. 4 depicts a front view of the mobile device according to aspects of the present disclosure.

FIG. 4 depicts a front view of the mobile device 100 according to aspects of the present disclosure. The mobile device 100 may include a housing 101 that forms the outer structure of the device. The housing 101 may comprise a top edge 102, a first side edge 104, a bottom edge 106, and a second side edge 108. The front surface 122 of the mobile device 100 may include a display area for user interaction. In some aspects, the front surface 122 may be substantially rectangular in shape.

Figure 5:
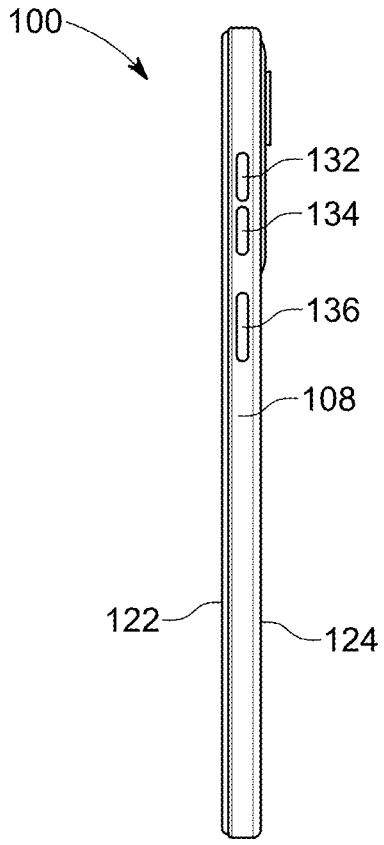
FIG. 5 depicts a side view of the mobile device according to aspects of the present disclosure.

The mobile device 100 may include one or more buttons disposed on the housing 101. As shown in FIG. 4, these buttons may include a first button 132, a second button 134, and a third button 136. In some implementations, these buttons may correspond to power and volume controls, though other button configurations and functions may be possible. For example, in some aspects, buttons 132 and 134 may increase and decrease volume, respectively. These buttons may have the same shape and dimensions. Button 136 may turn the power on and off. As depicted in FIG. 5, button 136 may comprise a different shape and/or dimensions from buttons 132 and 134. The buttons may be positioned along one or more edges of the mobile device 100, such as along the second side edge 108 as depicted. In some aspects, one or more buttons for controlling the volume, power, or other functionality may be positioned along one or more of top edge 102, first side edge 104, bottom edge 106, and second side edge 108.

In some aspects, the mobile device 100 may include additional features such as a camera 152. The camera 152 may be positioned on the front surface 122 of the mobile device 100, for example near the top edge as shown in FIG. 4. However, the position and number of cameras may vary in different implementations.

FIG. 5 depicts a side view of the mobile device 100 according to aspects of the present disclosure. This view provides a view of the second side edge 108 of the mobile device 100. The buttons 132, 134, and 136 are visible protruding from the second side edge 108. In some implementations, these buttons may be slightly raised from the edge to allow for tactile identification and ease of use.

The side view also illustrates the relationship between the front surface 122 and the rear surface 124 of the mobile device 100. The front surface 122 may be substantially planar and may house the display area of the device. The rear surface 124 may also be substantially planar and may form the back of the mobile device 100.

The thickness of the mobile device 100 can be observed in this side view, defined by the distance between the front surface 122 and the rear surface 124. This thickness may vary depending on the specific model and design of the mobile device 100. The edges of the mobile device 100, such as the second side edge 108 shown here, may be curved or chamfered to provide a comfortable grip and aesthetic appeal.

Figure 6:
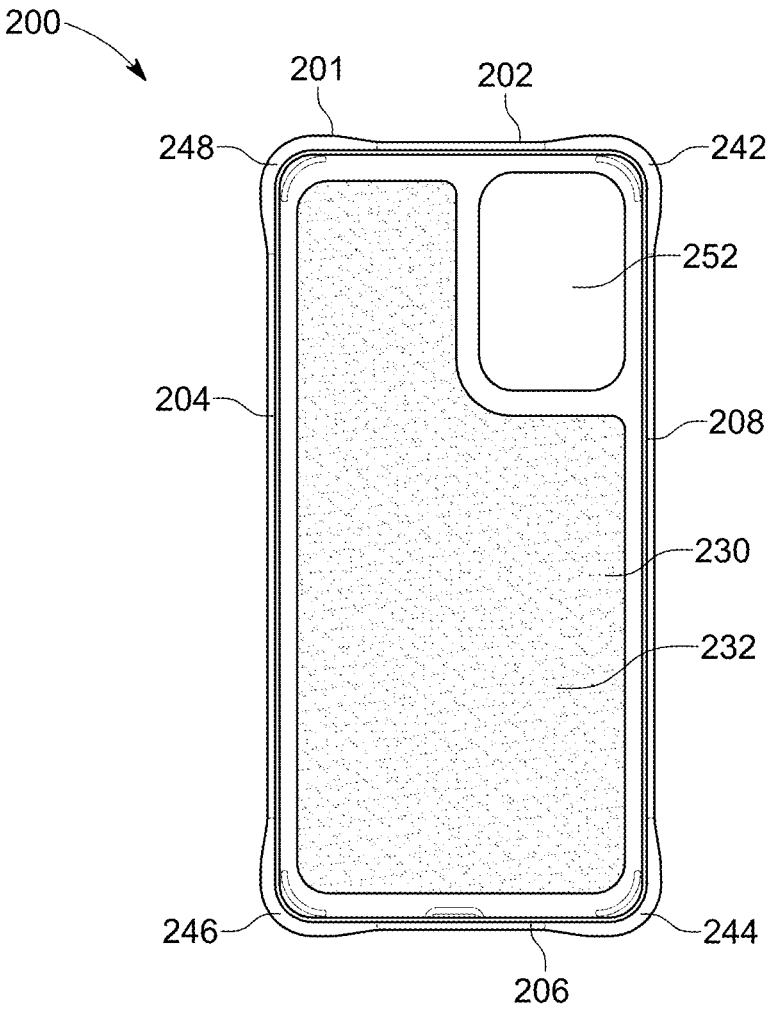
FIG. 6 depicts a front view of the case according to aspects of the present disclosure.

FIG. 6 depicts a front view of the case 200 according to aspects of the present disclosure. The case 200 may include a wall portion 201 that extends around the perimeter of the case. The wall portion 201 may comprise a top edge 202, a first side edge 204, a bottom edge 206, and a second side edge 208. As will be described in reference to other figures, each edge may include an inner or interior surface and an outer or exterior surface. For example, top edge 202 may include an outer surface 202*a* and an inner surface 202*b*, first side edge 204 may include an outer surface 204*a* and an inner surface 204*b*, bottom edge 206 may include an outer surface 206*a* and an inner surface 206*b*, and second side edge 208 may include an outer surface 208*a* and an inner surface 208*b*. The case 200 may also include a base layer or portion 230 with a front surface 232 visible in this view. The front surface 232 may be substantially rectangular in shape, corresponding to the shape of the mobile device it is designed to protect.

In some aspects, the first side edge 204 and the second side edge 208 of the case 200 may have a greater length than the top edge 202 and the bottom edge 206. This configuration may correspond to the rectangular shape of many mobile devices, such as smartphones, which typically have a longer length than width. The elongated side edges may allow the case 200 to accommodate the dimensions of these devices, providing full coverage and protection along the longer sides of the mobile device. This design may ensure that the case 200 fits snugly around the mobile device, offering comprehensive protection while maintaining the device's familiar form factor and allowing easy access to the screen and other features.

In some aspects, the case 200 may include corner portions with increased thickness for additional protection for, as an example, protecting against drops. As shown in FIG. 6, these may include a first corner portion 242, a second corner portion 244, a third corner portion 246, and a fourth corner portion 248. These thickened corner portions may provide additional shock absorption in areas prone to impact during drops.

The case 200 may include a cutout 252 for accommodating features of the mobile device, such as a camera. The position and size of this cutout may vary depending on the specific model of mobile device the case is designed for.

In some aspects, the wall portion 201 of the case 200 may be formed of a rigid material such as TPU. The use of TPU may be beneficial for its balance of flexibility and durability, which can be beneficial in absorbing impacts and facilitating the installation and removal of the mobile device 100 from the case 200. Additionally, other materials such as rubber, silicone, or various polymeric materials may also be used to construct the wall portion 201. These materials are selected for their robustness and ability to resist impacts, thereby offering substantial protection against drops and other forms of mechanical stress. Each material choice may be tailored to achieve a desired level of rigidity, flexibility, and aesthetic appeal, depending on user preferences and the specific requirements of the mobile device model being protected.

In some aspects, the base portion 230 may also be formed of the same rigid materials as the wall portion 201, such as TPU, rubber, or silicone. This construction may assist with drop protection by providing a consistent level of impact resistance across the entire case 200. The use of these materials for the base portion 230 may allow for a unified design that offers comprehensive protection for the mobile device 100. In some implementations, the base portion 230 may be integrally formed with the wall portion 201, creating a seamless protective structure. This integrated design may enhance the overall durability of the case 200 and may help distribute impact forces more evenly in the event of a drop. The specific material choice for the base portion 230 may be selected to complement the properties of the wall portion 201, optimizing the case's protective capabilities while maintaining a balance of flexibility and rigidity.

In some aspects, the base portion 230 and wall portion 201 may be formed of different materials. This configuration may allow for customization of the protective properties of different parts of the case 200. For example, the wall portion 201 may be constructed from a more rigid material such as hard plastic or polycarbonate to provide enhanced structural integrity and impact resistance around the edges of the mobile device 100. In some aspects, the use of a more rigid material for the wall portion 201 may assist in blocking a user from being able to press the buttons on the mobile device 100, as discussed in greater detail below. In some aspects the base portion 230 may be made from a softer, more flexible material like silicone or TPU to provide cushioning and shock absorption for the back of the device. This combination of materials may offer a balance of protection and flexibility, allowing the case to absorb impacts while maintaining a slim profile. Additionally, using different materials for the base portion 230 and wall portion 201 may enable the incorporation of various textures or finishes, potentially enhancing grip or aesthetic appeal. The specific choice of materials may be tailored to meet different user preferences or to address the particular vulnerabilities of different mobile device models.

In some aspects, the front surface 232 may comprise a material such as a microfiber lining. The microfiber lining may provide additional protection for the mobile device 100 when it is inserted into the case 200. This soft, fine material may help prevent scratches or other damage to the mobile device 100. Additionally, the microfiber material may provide a slight cushioning effect, further enhancing the protective qualities of the case 200.

In some aspects, the wall portion 201 of the case 200 may include raised edges that extend above the height of the mobile device 100 when it is inserted into the case. These raised edges may be configured to create a protective barrier around the front surface 122 of the mobile device 100, including its display area. This design feature may help protect the screen from scratches and damage that could occur if the device were to be placed face-down on a surface.

The raised edges may also provide additional protection in the event of a drop. If the mobile device 100 falls face-down while in the case 200, the raised edges may make initial contact with the ground or other surface, potentially preventing direct impact to the screen. This may help reduce the risk of cracking or shattering the display.

In some implementations, the height of the raised edges may be customized based on the specific model of mobile device 100 the case 200 is designed to protect. The raised edges may be uniform in height around the entire perimeter of the case, or they may vary in height along different edges. For example, the raised edges may be higher at the corners of the case, where impact during a drop may be more likely to occur.

The raised edges may be integrally formed with the wall portion 201 of the case 200, or they may be separate components attached to the wall portion. In some aspects, the raised edges may be made of the same material as the wall portion 201, such as TPU, rubber, or silicone, to provide consistent protection and flexibility. Alternatively, the raised edges may be constructed from a different material than the rest of the case, potentially offering enhanced shock absorption or durability in these areas.

Figure 7:
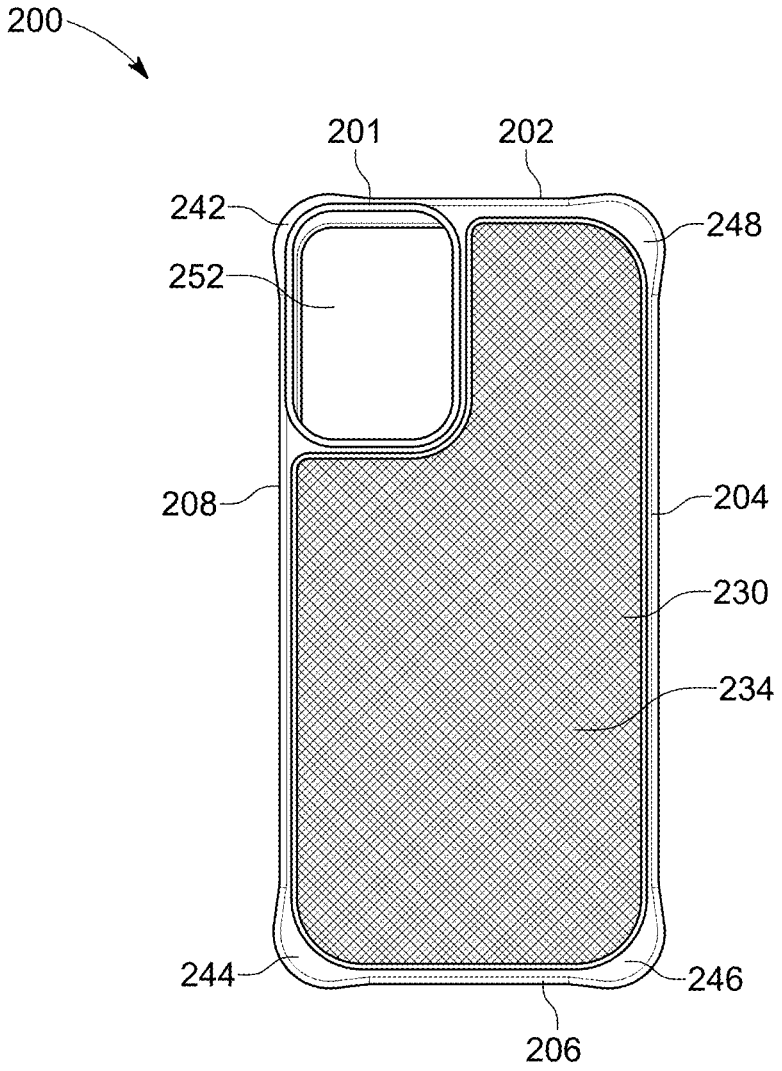
FIG. 7 depicts a rear view of the case according to aspects of the present disclosure.

FIG. 7 depicts a rear view of the case 200. This view shows the rear surface 234 of the base 230. The wall portion 201 with its top edge 202, first side edge 204, bottom edge 206, and second side edge 208 surround the perimeter of the rear surface 234. The cutout 252 for a camera or other features of the mobile device is also provided in the rear surface 234.

In some aspects, the rear surface 234 may comprise a textured pattern, such as a diamond-textured pattern, to assist with gripping and allow the user to securely hold the phone. This textured pattern may provide a non-slip surface that enhances the user's grip, particularly in conditions where the device might otherwise slip from the user's hand, such as when the hands are wet or when the device is being used in a dynamic environment.

Figure 8:
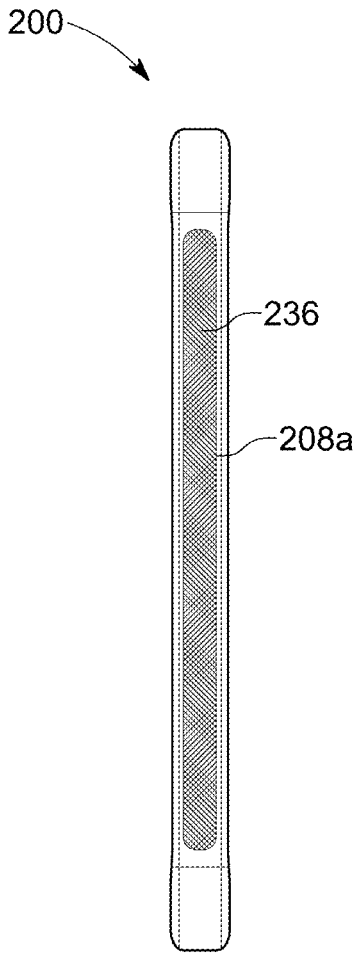
FIG. 8 depicts a first side view of the case according to aspects of the present disclosure.

FIG. 8 depicts a first side view of the case 200, showing the outer surface 208*a* of the second side edge 208. In some aspects, this outer surface may include a gripping portion 236. The gripping portion 236 may have a textured or contoured surface to enhance grip and prevent slipping when holding the device. In some aspects, the outer surface 208*a* may not include any protrusions or openings corresponding to buttons on the mobile device. This flat, uninterrupted surface may provide a sleek appearance while still allowing protection for the buttons underneath.

Figure 9:
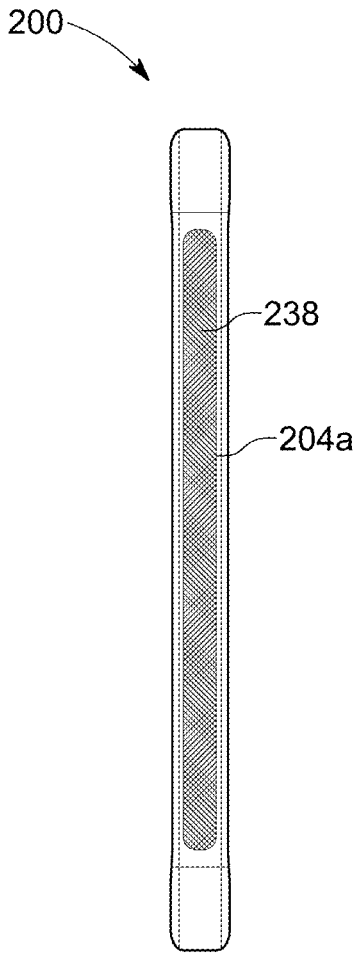
FIG. 9 depicts a second side view of the case according to aspects of the present disclosure.

FIG. 9 depicts a second side view of the case 200, showing the outer surface 204*a* of the first side edge 204. Similar to the opposite side, this surface may include a gripping portion 238 to improve handling of the device when inserted in the case. In some aspects, similar to the outer surface 208*a*, the outer surface 204*a* may not include any protrusions or openings corresponding to buttons on the mobile device. This flat, uninterrupted surface may provide a sleek appearance while still allowing protection for any buttons underneath.

Figure 10:
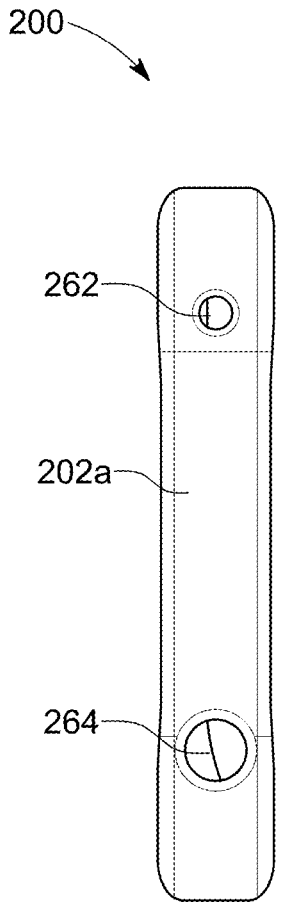
FIG. 10 depicts a top view of the case according to aspects of the present disclosure.

FIG. 10 depicts a top view of the case 200, showing the outer surface 202*a* of the top edge 202. In some implementations, this surface may include one or more cutouts, such as a first cutout 262 and a second cutout 264. These cutouts may provide access to features of the mobile device such as audio jacks, microphones, or other ports located on the top edge of the mobile device.

The lack of protrusions or openings and the flat surface on the outer surfaces 204*a* and 208*a* of the side surfaces 204 and 208 of the case 200 may be contrasted with the side surfaces of conventional phone cases where a user is intended to access the buttons of the mobile device. In conventional cases, protrusions or openings on the side surfaces may provide visual and/or tactile indications to help the user locate the buttons. These features in conventional cases may include raised areas that align with the device buttons, allowing the user to feel for and easily press the buttons through the case. Alternatively, some conventional cases may have openings that expose the device buttons directly. In contrast, the case 200 may intentionally omit such features on its outer surfaces 204*a* and 208*a*, presenting a smooth, uninterrupted exterior. This design may help prevent button presses while still offering protection for the enclosed mobile device.

In some aspects, the cutouts 262 and 264, as well as additional cutouts that may be present on the case 200, may take various shapes and differ from one another in shape and/or dimensions. The specific configuration of these cutouts may be tailored to accommodate different features or ports of the mobile device. For example, one cutout may be circular to allow access to an audio jack, while another may be elongated to accommodate a switch or slider. The dimensions of each cutout may also vary depending on the size and placement of the corresponding mobile device feature. In some implementations, the case 200 may include asymmetrical cutouts or cutouts with complex geometries to precisely match the contours of the mobile device. The number, placement, and design of these cutouts may be customized for different mobile device models or to provide access to specific functionalities.

Figure 11:
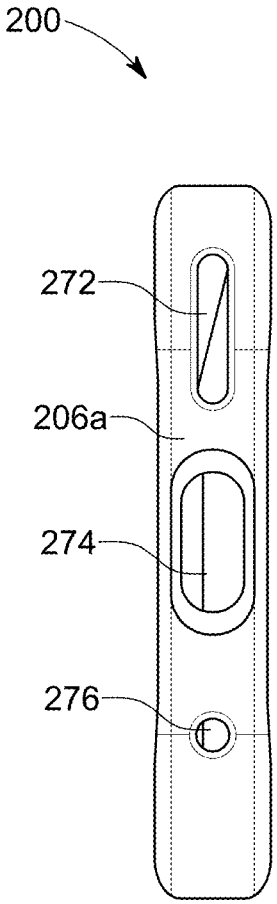
FIG. 11 depicts a bottom view of the case according to aspects of the present disclosure.

FIG. 11 depicts a bottom view of the case 200, showing the outer surface 206*a* of the bottom edge 206. This surface may include multiple cutouts, such as a first cutout 272, a second cutout 274, and a third cutout 276. These cutouts may allow access to various ports or features of the mobile device, such as charging ports, speakers, or microphones located on the bottom edge of the device.

In some aspects, the cutouts 272, 274, and 276, as well as other cutouts that may be present on the case 200, may take various shapes and differ from one another in shape and/or dimensions. The specific configuration of these cutouts may be tailored to accommodate different features or ports of the mobile device. For example, one cutout may be circular to allow access to a speaker, while another may be elongated to accommodate a charging port. The dimensions of each cutout may also vary depending on the size and placement of the corresponding mobile device feature. In some implementations, the case 200 may include asymmetrical cutouts or cutouts with complex geometries to precisely match the contours of the mobile device. The number, placement, and design of these cutouts may be customized for different mobile device models or to provide access to specific functionalities.

Figure 12:
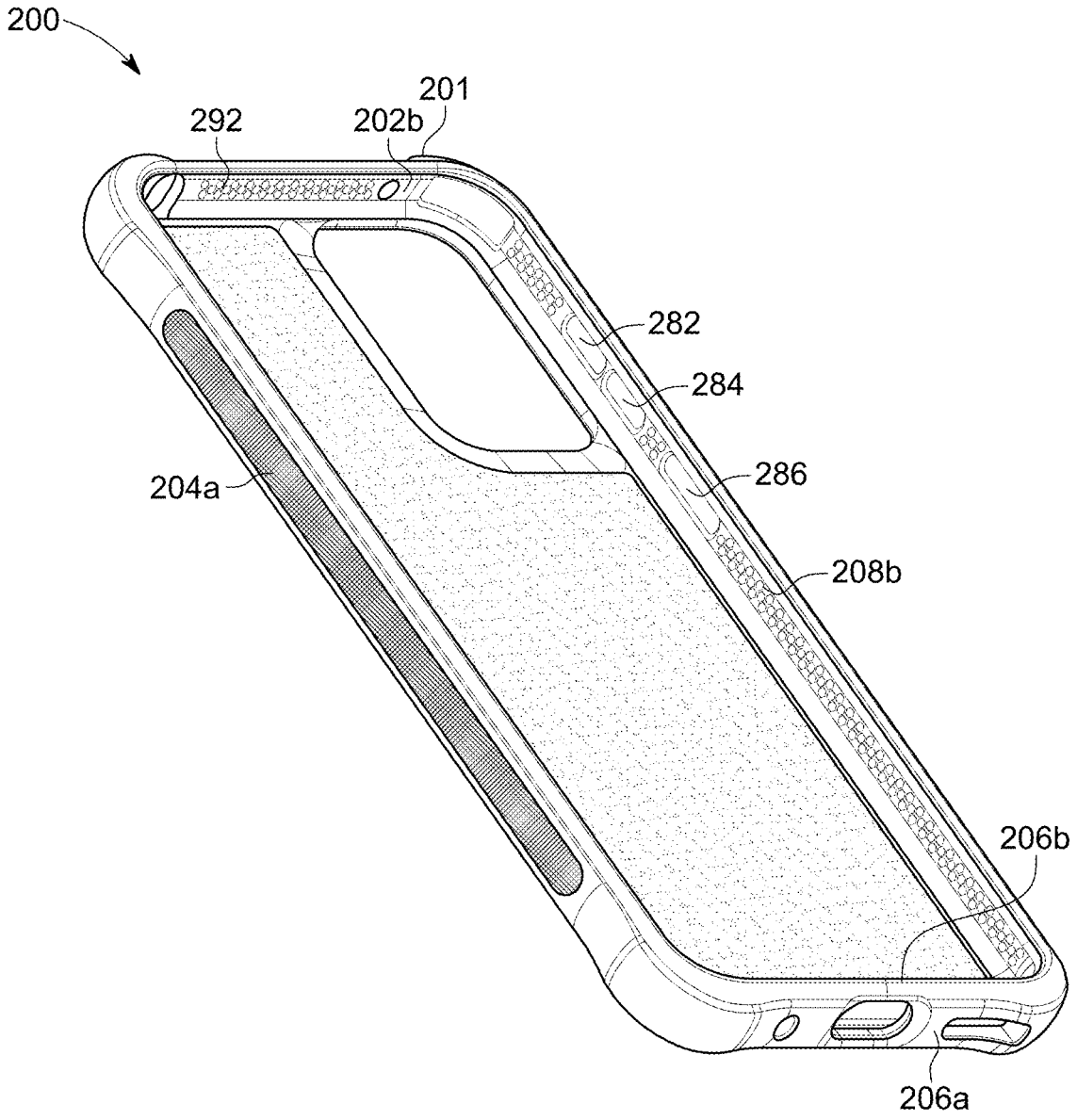
FIG. 12 depicts a first perspective view of the case according to aspects of the present disclosure.

FIG. 12 depicts a first perspective view of the case 200, providing a view of multiple surfaces simultaneously. This view shows the outer surface 206*a* of the bottom edge 206, the outer surface 204*a* of the first side edge 204, and provides a clear view of inner surfaces of the case. For example, the inner surface 208*b* of the second side edge is visible, showing indentations 282, 284, and 286. These indentations may correspond to the buttons on the mobile device (e.g., buttons 132, 134, and 136) and may be designed to prevent button presses when the device is inserted in the case.

In some aspects, while the indentations 282, 284, and 286 are shown on the inner surface 208*b* of the second side edge in this embodiment, the case 200 may include indentations on different or additional inner surfaces including inner surfaces 202*b*, 204*b*, and/or 206*b*. The location and configuration of these indentations may vary depending on the type of mobile device intended to be used with the case and the specific placement of buttons on that device. For example, some mobile devices may have buttons located on the top edge, bottom edge, or first side edge, and the case may be designed with corresponding indentations on the inner surfaces of those edges. Additionally, the number, size, and shape of the indentations may be customized to match the button layout of various mobile device models, allowing the case to be compatible with a range of devices while still providing the button-press prevention feature.

In some aspects, the indentations 282, 284, and 286 may be formed integrally with the inner surface 208*b* of the case 200. This integral formation may provide a seamless and durable design for the button-press prevention feature. The indentations may be molded or otherwise manufactured as part of the same piece of material that forms the inner surface 208*b*, rather than being added as separate components. This integrated approach may enhance the overall structural integrity of the case and may help ensure consistent performance of the button-press prevention feature over time. The integral formation may also allow for precise control over the depth, shape, and positioning of the indentations, enabling them to closely match the contours of the mobile device buttons they are designed to align with.

In some aspects, the indentations may take different shapes and dimensions from one another, depending on the buttons of the mobile device they are designed to align with. For example, in the embodiment shown in FIG. 12 and FIG. 14, indentations 282 and 284 may be intended to align with buttons 132 and 134 of mobile device 100, while indentation 286 may be intended to align with button 136. As such, indentations 282 and 284 may have the same or similar shapes and dimensions to each other, corresponding to the same or similar shapes and dimensions of buttons 132 and 134. In contrast, indentation 286 may have a different shape or dimension compared to indentations 282 and 284, reflecting the different shape or dimension of button 136 compared to buttons 132 and 134. This customized configuration of indentations may allow the case to accommodate the specific button layout of the mobile device while maintaining the button-press prevention feature.

In some aspects, indentations 282 and 284 may be spaced apart by a first distance, while indentation 284 may be spaced from indentation 286 by a second distance. The first distance and second distance may be the same or different, depending on the specific design of the case and the layout of the buttons on the mobile device it is intended to protect. In some implementations, such as the one shown in FIG. 12, the first distance may be less than the second distance. In some aspects, the second distance may be at least two times greater than the first distance. This configuration wherein the first and distances are different may occur because indentations 282 and 284 may correspond to two buttons of the same type on the mobile device, such as two buttons acting as a volume rocker for increasing or decreasing volume, where it may be beneficial for a user to access both buttons in close succession. These buttons may be located close to each other on the mobile device, resulting in a smaller spacing between their corresponding indentations in the case. In contrast, indentation 286 may correspond to a button of a different type on the mobile device, such as a power button. This button may be positioned further away from the volume buttons on the mobile device. As a result, indentation 286 may be spaced further away from indentations 282 and 284 compared to how close indentations 282 and 284 are to each other.

The spacing between indentations may be designed to closely match the spacing of buttons on the mobile device, allowing for precise alignment when the device is inserted into the case. This arrangement may help ensure that each indentation properly aligns with its corresponding button, maintaining the effectiveness of the button-press prevention feature while accommodating the specific layout of the mobile device's controls. In some aspects, the spacing between indentations may be customized for different mobile device models, reflecting variations in button placement across different devices. This customization may allow the case to provide optimal button-press prevention for a wide range of mobile devices while maintaining a snug and secure fit.

In some aspects, the indentations 282, 284, and 286 on the inner surface 208*b* of the case 200 may not be noticeable or viewable on the outer surface 208*a*. The outer surface 208*a* may maintain a smooth, continuous appearance without any protrusions, depressions, or other visible indicators of the indentations present on the inner surface. This design feature may allow the case to provide button press prevention functionality while preserving a sleek and uniform exterior aesthetic. The absence of visible indications on the outer surface may also enhance the overall protective capabilities of the case by maintaining a consistent outer layer without potential weak points or areas of reduced thickness.

In some aspects, one or more of the inner surfaces 202*b*, 204*b*, 206*b*, and 208*b* of the case may feature one or more honeycomb structures or patterns 292. This structure may provide additional shock absorption and protection for the mobile device.

In some aspects, such as shown in FIG. 12, one or more honeycomb structures 292 may be provided on inner surface 208*b* above, below, and in between the indentations 282, 284, and 286. The honeycomb structures 292 may extend across portions of the inner surface 208*b* not occupied by the indentations, creating a continuous pattern that surrounds and separates the indentations. This arrangement may provide several benefits to the case design.

The honeycomb structures 292 may offer additional shock absorption and protection for the areas of the mobile device adjacent to the buttons. In some implementations, these structures may help distribute impact forces more evenly across the inner surface of the case, potentially reducing the risk of damage to the mobile device in the event of a drop or impact.

The honeycomb structures 292 located between the indentations may serve multiple additional purposes. They may provide structural support to the areas of the case between the button indentations, helping to maintain the overall integrity of the case design. Additionally, these structures may act as a buffer between the indentations, potentially enhancing the button-press prevention feature by further isolating each indentation.

In some aspects, the honeycomb structures 292 may vary in size, shape, or density depending on their location relative to the indentations. For example, the structures immediately adjacent to the indentations may be smaller or more densely packed to provide targeted support and protection around the button areas. Conversely, the structures in areas further from the indentations may be larger or less dense, offering general shock absorption for the broader surface of the mobile device.

The integration of honeycomb structures 292 around the indentations may also contribute to the overall flexibility and durability of the case. These structures may allow the case to absorb and distribute forces more effectively, potentially extending the lifespan of both the case and the protected mobile device. In some implementations, the combination of indentations and surrounding honeycomb structures may create a balance between button-press prevention and overall device protection.

In some aspects, the first side edge 204 and the second side edge 208 of the case 200 may have a greater length than the top edge 202 and the bottom edge 206. This configuration may correspond to the rectangular shape of many mobile devices, such as smartphones, which typically have a longer length than width. The elongated side edges may allow the case 200 to accommodate the dimensions of these devices, providing full coverage and protection along the longer sides of the mobile device. This design may ensure that the case 200 fits snugly around the mobile device, offering comprehensive protection while maintaining the device's familiar form factor and allowing easy access to the screen and other features. As a result of this configuration, the inner surfaces 204*b* and 208*b* may have a correspondingly greater length than the inner surfaces 202*b* and 206*b*. This may allow the case 200 to provide consistent protection along the entire length of the mobile device's longer sides. The extended length of inner surfaces 204*b* and 208*b* may also provide additional space for features such as the indentations 282, 284, and 286, which may be designed to align with buttons or other controls typically found along the sides of mobile devices. In some implementations, the greater length of these inner surfaces may also allow for the incorporation of additional protective features or structures, such as an extended portion of the honeycomb structure or pattern 292, which may enhance the overall shock-absorbing capabilities of the case.

Figure 13:
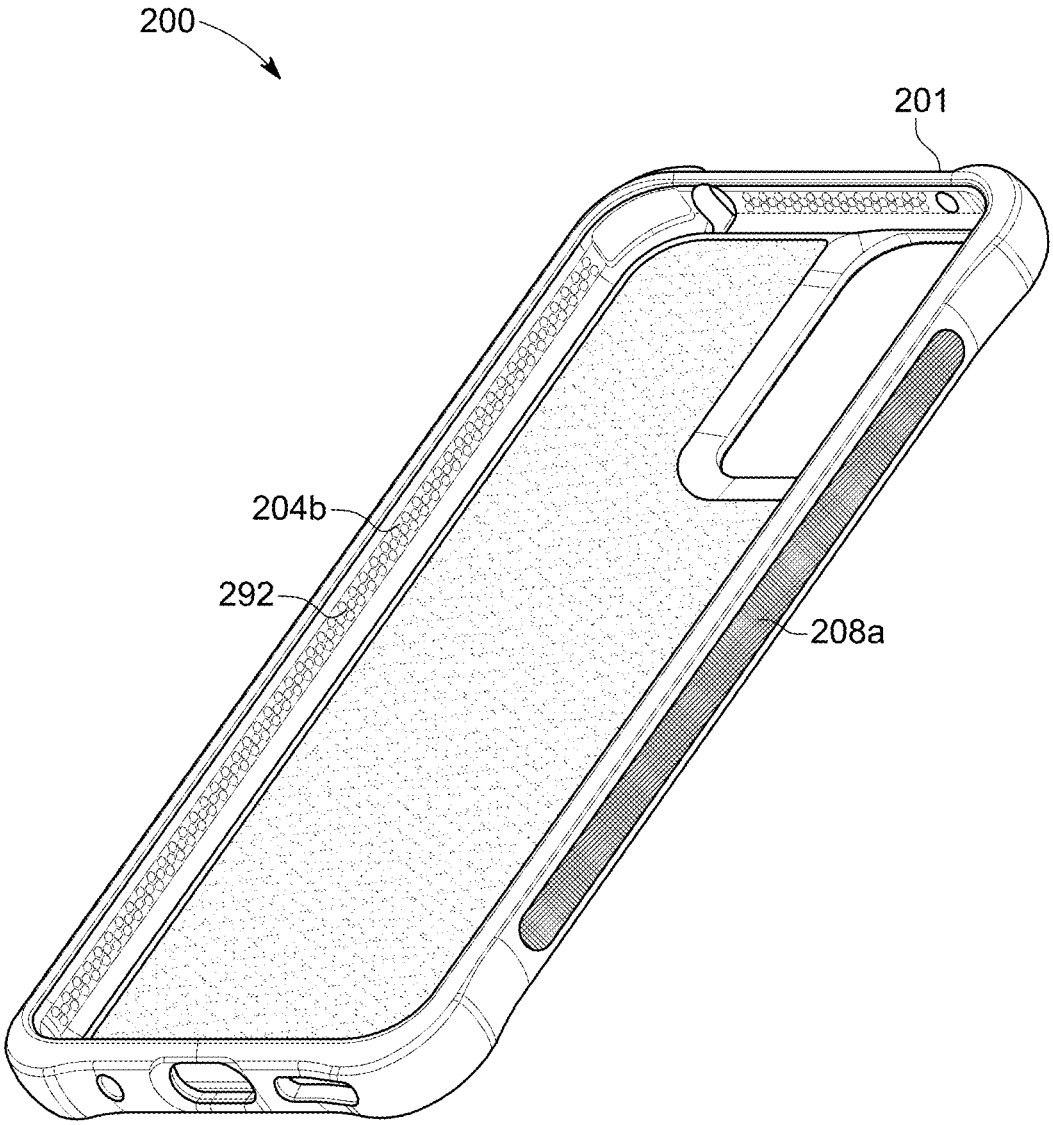
FIG. 13 depicts a second perspective view of the case according to aspects of the present disclosure.

FIG. 13 depicts a second perspective view of the case 200, showing the outer surface 208*a* of the second side edge and providing a view of the inner surface 204*b* of the first side edge. The honeycomb structure 292 is visible on the inner surfaces in this view as well.

Figure 14:
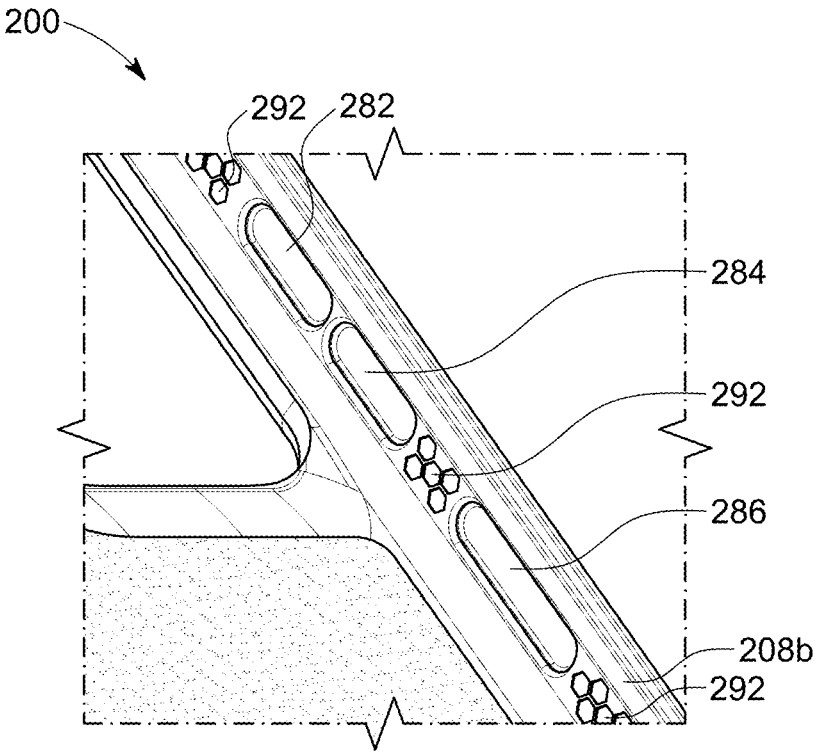
FIG. 14 depicts a close-up view of an inner surface of the case according to aspects of the present disclosure.

FIG. 14 depicts a close-up view of the inner surface 208*b* of the second side edge of the case 200. This detailed view clearly shows the indentations 282, 284, and 286, which may correspond to the buttons on the mobile device. The honeycomb structure 292 is also visible in greater detail in this view. The specific shape, size, and arrangement of these features may vary depending on the design of the case and the mobile device it is intended to protect.

In some aspects, the case 200 may be designed to address specific user needs, such as those of seniors with cognitive decline. For example, the case 200 may be beneficial for users experiencing dementia, which can affect the user's memory and ability to reason. The case may prevent both intentional and accidental activation of certain mobile device functions by blocking access to specific buttons. For example, the indentations 282, 284, and 286 on the inner surface 208*b* may be configured to align with the power button and volume rocker of the mobile device 100, effectively preventing the user from pressing these buttons when the device is inserted in the case. This feature may help ensure that the mobile device remains powered on and ready for use, which may be particularly beneficial for users who might have difficulty turning the device back on if it were accidentally switched off. This feature may also help maintain the device in a consistent, operational state, which may be particularly advantageous for users who may struggle with remembering how to power on the device or adjust settings. Similarly, it may prevent situations where a user intentionally adjusts the volume and subsequently forgets about the change, leading to confusion or frustration during later use. The case may also deter users from pressing buttons out of curiosity or experimentation, which could result in unintended changes to the device's settings that the user may struggle to reverse. Additionally, the case design may reduce frustration and anxiety for users with cognitive decline by minimizing instances of accidental device shutdowns or unwanted changes to device settings, potentially promoting greater independence and confidence in using the mobile device. The case 200 may thus provide not only physical protection for the mobile device but also functional safeguards tailored to specific user requirements.

In some aspects, the wall portion 201 of the case 200 may be designed with sufficient thickness to prevent a user from being able to press the buttons on the mobile device when it is inserted into the case. The thickness of the wall portion 201 may be selected to provide a rigid barrier between the user's fingers and the buttons of the mobile device. This design feature may work in conjunction with the indentations on the inner surface to enhance the button-press prevention functionality of the case.

The wall thickness may vary depending on the specific model of mobile device the case is designed to protect. In some implementations, the thickness of the wall portion 201 may be greater in edges or specific portions thereof that correspond to the locations of buttons on the mobile device. The wall thickness may vary depending on the specific model of mobile device the case is designed to protect. In some implementations, the thickness of the wall portion 201 may be greater in edges or specific portions thereof that correspond to the locations of buttons on the mobile device. For example, in the embodiment illustrated in FIGS. 12 and 14, the second side edge 208 may have a greater thickness than the top edge 202, first side edge 204, and bottom edge 206. This increased thickness of edge 208 may provide additional protection for the buttons of the mobile device, further enhancing the button-press prevention functionality of the case. The variable thickness design may allow for targeted reinforcement in areas that correspond to the device's buttons while maintaining a slimmer profile in other areas of the case.

In some aspects, the thickness of the wall portion 201 at the side corresponding to the buttons, such as the second side edge 208, may be greater than a thickness of the base portion 230. This increased thickness may provide enhanced protection for the buttons and contribute to the button-press prevention functionality of the case 200. The thicker wall at the button locations may create a more substantial barrier between the user's fingers and the device buttons, potentially further reducing the possibility of button presses. In some aspects, the thickness of the wall portion 201 at all four edges (top edge 202, first side edge 204, bottom edge 206, and second side edge 208) may be greater than the thickness of the base portion 230. This design feature may provide uniform protection around the entire perimeter of the mobile device, potentially enhancing the overall durability and shock-absorbing capabilities of the case 200. In some aspects, the thickness of one or more of the wall surfaces of the case 200 may be at least 10% greater than the thickness of the base layer 230. In some aspects, the thickness of one or more of the wall surfaces of the case may be 25% greater than that of the base layer 230.

In some aspects, the design of the case 200 with thicker wall portions relative to the base portion 230 may allow for a lighter overall case while still providing button-blocking functionality and protection against drops. By concentrating material in the wall portion 201, particularly in areas corresponding to device buttons, the case 200 may achieve its protective and functional goals while using less material in the base portion 230. This configuration may result in a lighter case compared to designs that use uniform thickness throughout. The thicker wall portions, such as those in the second side edge 208, may provide the necessary rigidity and depth for the indentations 282, 284, and 286 to effectively prevent button presses. Meanwhile, the thinner base layer 230 may still offer adequate protection for the back of the mobile device against impacts and scratches. The combination of these design elements may allow for a balance between weight reduction and protective capabilities. In some implementations, the use of less material in the base portion 230 may also contribute to improved heat dissipation from the mobile device. The thinner base may allow for more efficient transfer of heat generated by the device during operation, potentially helping to maintain optimal device performance.

The weight reduction achieved through this design may be particularly beneficial for users who prefer lighter cases or who may have difficulty handling heavier devices. For example, seniors or individuals with limited hand strength may find the lighter case easier to hold and manipulate, potentially increasing their comfort and ability to use the mobile device for extended periods.

In some aspects, the thickness of the wall 201 at all four edges (top edge 202, first side edge 204, bottom edge 206, and second side edge 208) may be greater than that of a standard protective case. For example, the wall thickness may be at least 10% thicker than corresponding walls in conventional cases that do not prevent a user from pressing the buttons on the mobile device. In some aspects, the wall thickness may be 25% thicker than corresponding walls in conventional cases that do not prevent a user from pressing the buttons on the mobile device. In some aspects, the wall thickness at one or more of the edges 202, 204, 206, and 208 may be 2 mm or greater. In some aspects, the wall thickness may be 2.5 mm. In some aspects, the wall thickness of the wall portion 201 at the second side edge 208 corresponding to the buttons of the mobile device may be 2.5 mm. In some aspects, the wall thickness of the wall portion 201 at each of the edges 202, 204, 206, and 208 may be 2.5 mm. This increased thickness may enhance the overall stiffness and rigidity of the case 200, potentially providing improved protection against impacts and drops. The thicker wall design may also allow for deeper button cavities that form the indentations 282, 284, and 286 on the inner surface of the case. This design feature may further enhance the button-press prevention functionality of the case, as the increased depth of the indentations may ensure that even if pressure is applied to the outer surface of the case, it may not be sufficient to activate the buttons on the enclosed mobile device.

In some aspects, the material composition of the wall portion 201 may also contribute to its ability to prevent button presses. The wall may be constructed from a rigid material such as TPU that resists deformation when pressure is applied, further enhancing its effectiveness in preventing accidental button activation. This rigidity may be balanced with other design considerations, such as overall case flexibility and shock absorption capabilities.

The combination of wall thickness, material properties, and the presence of indentations on the inner surface may create a multi-layered approach to button-press prevention. This design may provide effective protection against accidental button presses while still allowing the case to maintain other protective features and a user-friendly form factor.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations are not intended to convey that the claimed subject matter requires features or combinations of features other than those expressly recited in the claims. Accordingly, the scope of this disclosure is intended to include all modifications and variations encompassed within the spirit and scope of the following appended claims.

The invention claimed is:

1. A mobile device system, comprising:

a mobile device having a housing and at least one button disposed on the housing; and a case configured to receive the mobile device, the case comprising:

an outer surface; and an inner surface having at least one indentation corresponding to the at least one button of the mobile device, wherein the at least one indentation is configured such that a user is prevented from activating the at least one button while the mobile device is inserted into the case.

2. The mobile device system of claim 1, wherein a portion of the outer surface that aligns with the at least one button while the mobile device is inserted into the case is flush with surrounding portions of the outer surface surrounding the at least one button and lacks protrusions, thereby visually concealing a presence of the at least one button.

3. The mobile device system of claim 1, wherein the at least one indentation comprises a first indentation and a second indentation, and wherein the first indentation and the second indentation have different shapes or dimensions.

4. The mobile device system of claim 1, wherein the at least one indentation is integrally formed with the inner surface of the case.

5. The mobile device system of claim 1, wherein the case comprises a shock-absorbing material.

6. The mobile device system of claim 5, wherein the shock-absorbing material is selected from the group consisting of silicone, rubber, and thermoplastic polyurethane (TPU).

7. The mobile device system of claim 1, wherein the at least one indentation comprises at least a first indentation, a second indentation, and a third indentation; wherein the first indentation and the second indentation are spaced by a first distance; wherein the second indentation is located between the first indentation and the third indentation; wherein the second indentation and the third indentation are spaced by a second distance; and wherein the second distance is greater than the first distance.

8. The mobile device system of claim 1, wherein the at least one button includes power and volume buttons.

9. The mobile device system of claim 1, wherein the case is configured to allow access to one or more ports of the mobile device while preventing access to the at least one button.

10. A case for a mobile device, comprising:

an outer surface;

an inner surface configured to receive the mobile device, the inner surface having at least one indentation corresponding to at least one button of the mobile device, wherein the at least one indentation is configured such that a user is prevented from activating the at least one button while the mobile device is inserted into the case.

11. The case of claim 10, wherein a portion of the outer surface that aligns with the at least one button while the mobile device is inserted into the case is flush with surrounding portions of the outer surface surrounding the at least one button and lacks protrusions, thereby visually concealing a presence of the at least one button.

12. The case of claim 10, wherein the at least one indentation comprises a first indentation and a second indentation, and wherein the first indentation and the second indentation have different shapes or dimensions.

13. The case of claim 10, wherein the at least one indentation is integrally formed with the inner surface of the case.

14. The case of claim 10, wherein the case comprises a shock-absorbing material.

15. The case of claim 14, wherein the shock-absorbing material is selected from the group consisting of silicone, rubber, and thermoplastic polyurethane (TPU).

16. The case of claim 10, wherein the at least one indentation comprises at least a first indentation, a second indentation, and a third indentation; wherein the first indentation and the second indentation are spaced by a first distance; wherein the second indentation is located between the first indentation and the third indentation; wherein the second indentation and the third indentation are spaced by a second distance; and wherein the second distance is greater than the first distance.

17. The case of claim 10, wherein the outer surface is a first outer surface, wherein the case further includes a second outer surface, a third outer surface, and a fourth outer surface, wherein the first outer surface is located opposite the third outer surface, the second outer surface is located opposite the fourth outer surface, the first outer surface and the third outer surface have a greater length than the second outer surface and the fourth outer surface, and the first outer surface and the third outer surface are flat and do not contain any protrusions or openings.

18. The case of claim 17, wherein at least one of the second outer surface or the fourth outer surface includes one or more openings configured to provide access to one or more ports of the mobile device.

19. The case of claim 10, wherein the inner surface having the at least one indentation is a first inner surface, wherein the case further includes a second inner surface, a third inner surface, and a fourth inner surface, wherein the first inner surface is located opposite the third inner surface, the second inner surface is located opposite the fourth inner surface, and the first inner surface and the third inner surface have a greater length than the second inner surface and the fourth inner surface.

20. The case of claim 19, wherein at least one of the second inner surface or the fourth inner surface includes one or more openings configured to provide access to one or more ports of the mobile device.

* * * * *